US011952756B2

(12) United States Patent
Escobar, III et al.

(10) Patent No.: US 11,952,756 B2
(45) Date of Patent: Apr. 9, 2024

(54) WATER TRANSFER DEVICE, AND A CLEANING IMPLEMENT AND A WATER-DISPENSING PULLOUT WAND OF A PULLDOWN FAUCET FORMED THEREWITH

(71) Applicants: Francisco Escobar, III, Mesa, AZ (US); Jenny M. Escobar, Mesa, AZ (US)

(72) Inventors: Francisco Escobar, III, Mesa, AZ (US); Jenny M. Escobar, Mesa, AZ (US)

( * ) Notice: Subject to any disclaimer, the term of this patent is extended or adjusted under 35 U.S.C. 154(b) by 177 days.

(21) Appl. No.: 17/714,726

(22) Filed: Apr. 6, 2022

(65) Prior Publication Data

US 2023/0323643 A1 Oct. 12, 2023

(51) Int. Cl.
*E03C 1/04* (2006.01)
*A47L 17/00* (2006.01)

(52) U.S. Cl.
CPC ..... *E03C 1/0404* (2013.01); *A47L 17/00* (2013.01); *E03C 2001/0414* (2013.01)

(58) Field of Classification Search
CPC . E03C 1/0404; E03C 2001/0414; A47L 17/00
USPC ..... 4/628, 619
See application file for complete search history.

(56) References Cited

U.S. PATENT DOCUMENTS 5,316,401 A * 5/1994 Sears ..... A47L 17/00 401/203
6,019,537 A * 2/2000 Hunt ..... A47L 17/04 401/289
6,035,477 A * 3/2000 Robert ..... A46B 11/06 401/289
6,602,010 B1 * 8/2003 Doyle ..... E03C 1/08 401/289
7,004,663 B1 * 2/2006 Cupidon-Ebanks .... A47L 13/22 401/278
8,342,768 B1 * 1/2013 Johnston ..... A46B 5/0095 401/289
8,955,536 B2 * 2/2015 Bell ..... E03B 1/04 422/275
9,428,889 B2 * 8/2016 Reiman ..... E03C 1/04
10,036,148 B1 * 7/2018 Rodriguez ..... E03C 1/04
11,542,691 B2 * 1/2023 Porter ..... E03C 1/0404
2005/0125893 A1 * 6/2005 Zhadanov ..... E03C 1/0404 4/675
2006/0026750 A1 * 2/2006 Ballance ..... A47K 3/281 4/605

(Continued)

FOREIGN PATENT DOCUMENTS

CA 2998608 A1 * 9/2018 ..... E03C 1/0401
CA 3014794 A1 * 2/2019 ..... E03C 1/084
WO WO-2017173481 A1 * 10/2017 ..... A46B 11/06

*Primary Examiner* — Lori L Baker
(74) *Attorney, Agent, or Firm* — Parsons & Goltry, PLLC; Michael W. Goltry; Robert A. Parsons

(57) ABSTRACT

A hollow body fluidly coupling a water-dispensing pullout wand of a pulldown faucet to an applicator, the hollow body including openings therethrough between the pullout wand and the applicator, the openings enabling water applied to the hollow body from the pullout wand to flow outwardly therethrough and over the applicator from the hollow body between the pullout wand and the applicator.

30 Claims, 11 Drawing Sheets

(56) References Cited

U.S. PATENT DOCUMENTS

| | | | | |
|---|---|---|---|---|
| 2006/0233592 | A1* | 10/2006 | Knopow | A47L 13/26 401/139 |
| 2007/0071542 | A1* | 3/2007 | Cicero | A46B 11/066 401/289 |
| 2016/0088927 | A1* | 3/2016 | Knight | B25G 1/04 15/4 |
| 2020/0325663 | A1* | 10/2020 | Porter | E03C 1/086 |
| 2022/0381012 | A1* | 12/2022 | Fazio | E03C 1/0404 |

* cited by examiner

WATER TRANSFER DEVICE, AND A CLEANING IMPLEMENT AND A WATER-DISPENSING PULLOUT WAND OF A PULLDOWN FAUCET FORMED THEREWITH

FIELD OF THE INVENTION

The present invention generally relates to water-dispensing wands of pulldown faucets, to applicators, such as sponges or scrubbers, useful for cleaning dishware, cookware, cutlery, and drinkware, and to a water transfer device configured to fluidly couple the pullout wand to the applicator.

BACKGROUND OF THE INVENTION

Handled cleaning tools are common household cleaning aids that typically include a gripping handle having an attached applicator, typically a cleaning pad or sponge mounted. A user holds the tool by its handle and cleans a surface with the applicator. Some cleaning implements are dispensing tools, tools that include a self-contained handle configured to store a liquid cleaner, normally a liquid soap, and dispense it under the influence of gravity to an attached applicator, providing the applicator with a suitable supply of the liquid cleaner for cleaning a surface in contact with the applicator. Some dispensing tools supply the applicator with a continuous or unregulated and overwhelming flow of the liquid cleaner. Others regulate the flow of the liquid cleaner to the applicator with flow regulators. In either case, the liquid cleaner inherently lingers in and on the applicator and the flow interface and thickens and hardens, which requires repeated and time-consuming cleaning of the tool to ensure it functions properly. Dispensing tools that incorporate flow regulars are expensive and easily break.

Consumers ordinarily use the described dispensing tools to clean dishware, cookware, cutlery, and drinkware at the kitchen sink with water from the faucet. There are a wide variety of faucets commonly employed with kitchen sinks. One popular variety is the "pulldown" faucet. A standard pulldown faucet includes a spout and a pullout wand. The spout has a hub or base mounted rotatably over a pedestal mounted to the sink's deck, and the base has an outlet or receiver, removably receiving a pullout wand. The base and its receiver slidably receive a flexible conduit fluidly coupling the pullout wand to the hot/cold water supply, enabling movement of the pullout wand between a docked position docked to the receiver and an undocked position extended from the receiver. The pullout wand is easily moved and pointed in different directions for projecting its flow of water where desired when undocked and extended from the receiver. The pullout wand of a pulldown faucet is essentially a water-dispensing handle that is gripped by hand and maneuvered about as needed. Consumers use the dispensing tools by holding one with one hand and kitchen items with the other, often while water is running over the given item from the pullout wand docked to the receiver. The dispensing tool is normally set down after one or more kitchen items are cleaned to enable a user to take up the pullout wand by hand, undock it, and rinse the kitchen items as needed. Repeatedly picking up and setting down a dispensing tool to enable the intended use of the pullout wand of a pulldown faucet is tedious and frustrating.

SUMMARY OF THE INVENTION

According to the principle of the invention, improvements to a water-dispensing pullout wand of a pulldown faucet and an applicator are disclosed. The improvements include a hollow body fluidly coupling the pullout wand to the applicator, and openings through the hollow body between the pullout wand and the applicator, the openings enabling water applied to the hollow body from the pullout wand to flow outwardly therethrough and over the applicator from the hollow body between the pullout wand and the applicator. The openings are throughout the hollow body between the pullout wand and the applicator. The hollow body is received releasably over the pullout wand fluidly coupling the pullout wand to the applicator. An engagement assembly releasably couples the hollow body to the applicator. The engagement assembly includes an element thereof carried by the hollow body and a complemental element thereof carried by the applicator, the element in releasable engagement to the complemental element. The element is one of a tongue and a receiver and the complemental element is another one of the tongue and the receiver, the releasable engagement being the tongue received releasably by the receiver.

According to the principle of the invention, a cleaning implement includes a hollow body and an applicator. The hollow body includes a proximal extremity configured to be fluidly coupled to a water-dispensing pullout wand of a pulldown faucet, a distal extremity coupled to the applicator, at least one opening through the distal extremity fluidly coupling the proximal extremity to the applicator, and openings through the hollow body between the proximal extremity and the distal extremity, the openings enabling water applied to the hollow body through the proximal extremity from the pullout wand to flow outwardly therethrough and over the applicator from the hollow body between the proximal extremity and the distal extremity when the proximal extremity is fluidly coupled to the pullout wand. The openings are throughout the hollow body between the proximal extremity and the distal extremity. The proximal extremity is configured to be received releasably over the pullout wand for fluidly coupling the proximal extremity to the pullout wand. An engagement assembly releasably couples the hollow body to the applicator. The engagement assembly includes an element thereof carried by the hollow body and a complemental element thereof carried by the applicator, the element in releasable engagement to the complemental element. The element is one of a tongue and a receiver and the complemental element is another one of the tongue and the receiver, the releasable engagement being the tongue received releasably by the receiver.

According to the principle of the invention, a water transfer device includes a hollow body including a proximal extremity configured to be fluidly coupled to a water-dispensing pullout wand of a pulldown faucet, a distal extremity configured to be coupled to an applicator, at least one opening through the distal extremity, the at least one opening fluidly coupling the proximal extremity to the applicator when the distal extremity is coupled to the applicator, and openings through the hollow body between the proximal extremity and the distal extremity, the openings enabling water applied to the hollow body through the proximal extremity from the pullout wand to flow outwardly therethrough and over the applicator from the hollow body between the proximal extremity and the distal extremity when the proximal extremity is fluidly coupled to the pullout wand and the distal extremity is coupled to the applicator. The openings are throughout the hollow body between the proximal extremity and the distal extremity. The proximal extremity is configured to be received releasably over the pullout wand for fluidly coupling the proximal extremity to the pullout wand. An engagement assembly is configured to couple the distal extremity to the applicator. The engagement assembly includes an element thereof carried by the distal extremity and a complemental element thereof carried by the applicator, the element configured to releasably engage the complemental element. The element is one of a tongue and a receiver and the complemental element is another one of the tongue and the receiver, the tongue configured to releasably engage the receiver by being received releasably by the receiver.

According to the principle of the invention, improvements to a water-dispensing pullout wand of a pulldown faucet and an applicator are disclosed. The improvements include a hollow body including an annular wall extending between an open top fluidly coupled to the pullout wand and a bottom wall coupled to the applicator, least one opening through the bottom wall fluidly coupling the proximal extremity to the applicator, and openings through the annular wall between the open top and the bottom wall, the openings enabling water applied to the hollow body through the open top from the pullout wand to flow outwardly therethrough and over the applicator from the annular wall between the open top and the bottom wall. The openings are throughout the annular wall. The open top is received releasably over the pullout wand fluidly coupling the open top to the pullout wand. An engagement assembly releasably couples the bottom wall to the applicator. The engagement assembly includes an element thereof carried by the bottom wall and a complemental element thereof carried by the applicator, the element in releasable engagement to the complemental element. The element is one of a tongue and a receiver and the complemental element is another one of the tongue and the receiver, the releasable engagement including the tongue received releasably by the receiver.

According to the principle of the invention, a cleaning implement includes a hollow body including an annular wall extending between an open top configured to be fluidly coupled to a water-dispensing pullout wand of a pulldown faucet and a bottom wall coupled to an applicator, at least one opening through the bottom wall fluidly coupling the proximal extremity to the applicator, and openings through the annular wall between the open top and the bottom wall, the openings enabling water applied to the hollow body through the open top from the pullout wand to flow outwardly therethrough and over the applicator from the annular wall between the open top and the bottom wall when the open top is fluidly coupled to the pullout wand. The openings are throughout the annular wall. The open top is configured to be received releasably over the pullout wand for fluidly coupling the open top to the pullout wand. An engagement assembly releasably couples the bottom wall to the applicator. The engagement assembly includes an element thereof carried by the bottom wall and a complemental element thereof carried by the applicator, the element in releasable engagement to the complemental element. The element is one of a tongue and a receiver and the complemental element is another one of the tongue and the receiver, the releasable engagement including the tongue received releasably by the receiver.

According to the principle of the invention, a water transfer device includes a hollow body including an annular wall extending between an open top configured to be fluidly coupled to a water-dispensing pullout wand of a pulldown faucet and a bottom wall configured to be coupled to an applicator, at least one opening through the bottom wall, the at least one opening fluidly coupling the open top to the applicator when the bottom wall is coupled to the applicator, and openings through the annular wall between the open top and the bottom wall, the openings enabling water applied to the hollow body through the open top from the pullout wand to flow outwardly therethrough and over the applicator from the annular wall between the open top and the bottom wall when the open top is fluidly coupled to the pullout wand and the bottom wall is coupled to the applicator. The openings are throughout the annular wall. The open top is configured to be received releasably over the pullout wand for fluidly coupling the open top to the pullout wand. An engagement assembly is configured to couple the bottom wall to the applicator. The engagement assembly includes an element thereof carried by the bottom wall and a complemental element thereof carried by the applicator, the element configured to releasably engage the complemental element. The element is one of a tongue and a receiver and the complemental element is another one of the tongue and the receiver, the tongue configured to releasably engage the receiver by being received releasably by the receiver.

BRIEF DESCRIPTION OF THE DRAWINGS

Specific objects and advantages of the invention will be apparent to those skilled in the art from the following detailed description of illustrative embodiments thereof, taken in conjunction with the drawings in which.

DETAILED DESCRIPTION

Figure 1:
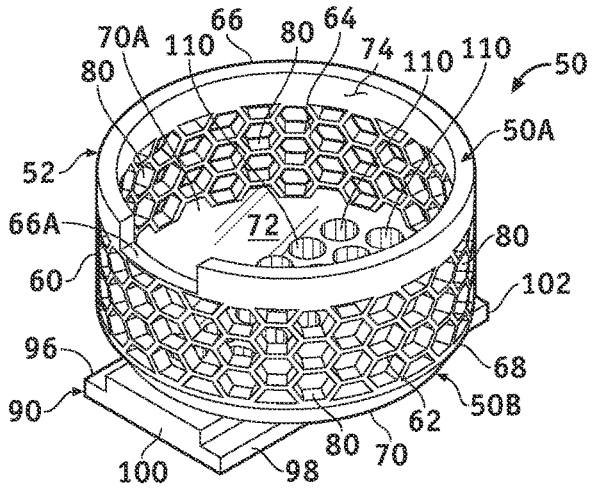
FIG. 1 is a to perspective view of a water transfer device constructed and arranged in accordance with the principle of the invention.
Figure 2:
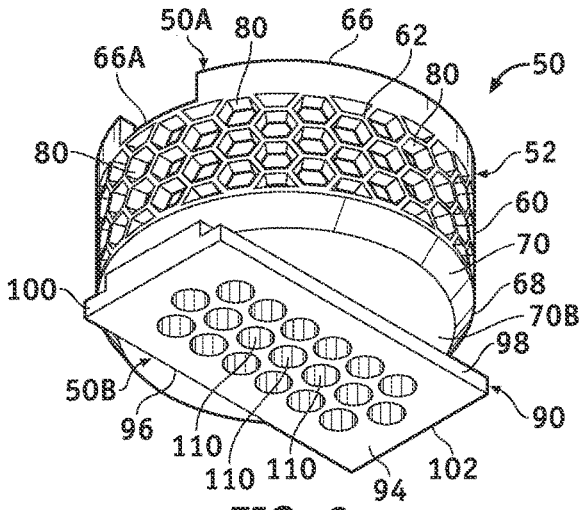
FIG. 2 is a bottom perspective view of the embodiment of FIG. 1.
Figure 3:
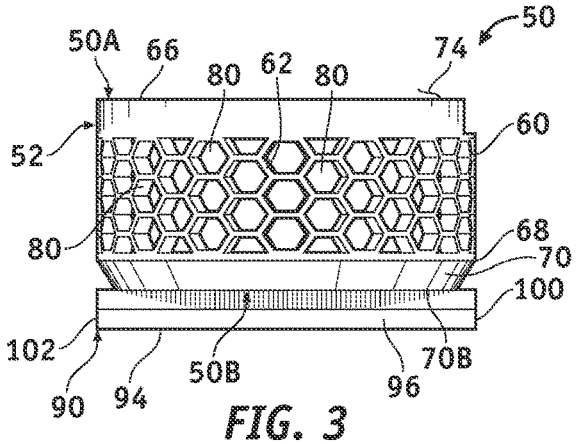
FIG. 3 is a side elevation view of the embodiment of FIG. 1, the opposite side elevation view being the same thereof.
Figure 4:
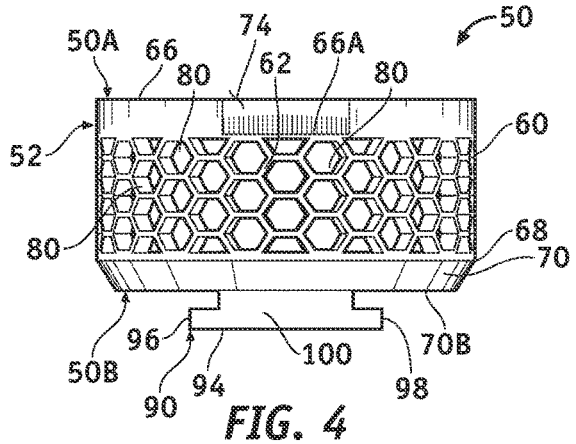
FIG. 4 is a front elevation view of the embodiment of FIG. 1.
Figure 5:
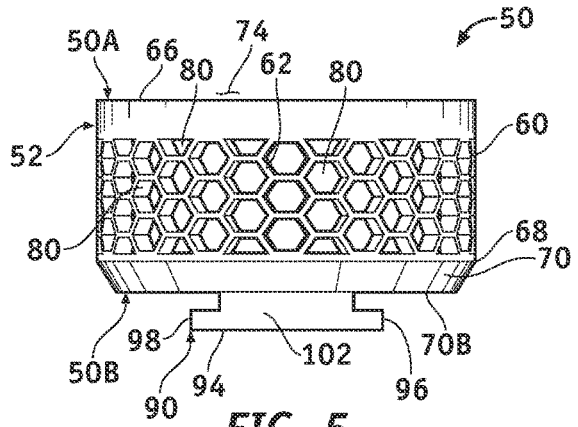
FIG. 5 is a rear elevation view of the embodiment of FIG. 1.
Figure 6:
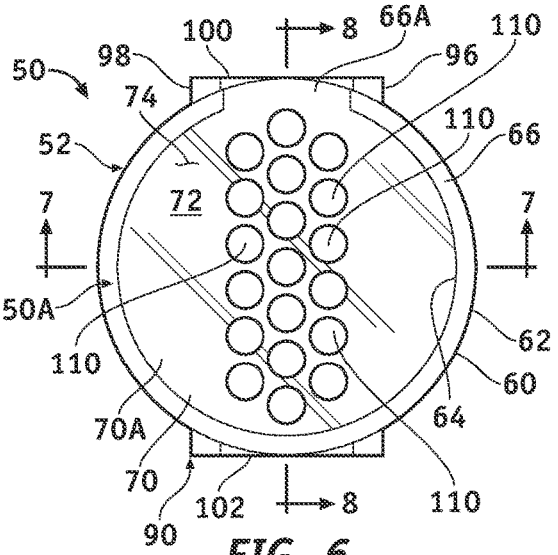
FIG. 6 is a top plan view of the embodiment of FIG. 1.
Figure 7:
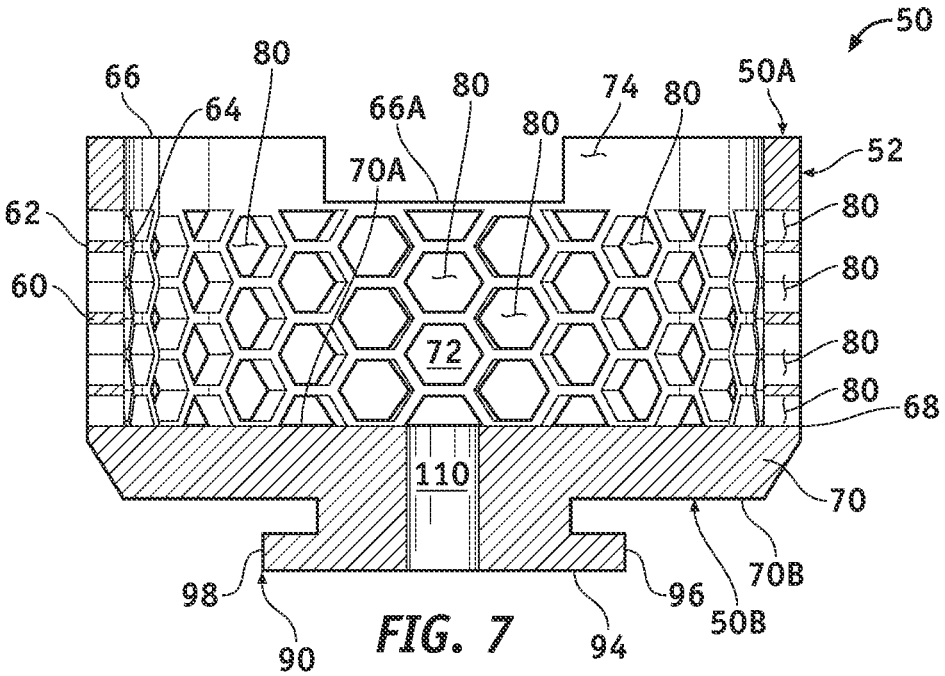
FIG. 7 is a section view taken along line 7-7 of FIG. 6.
Figure 8:
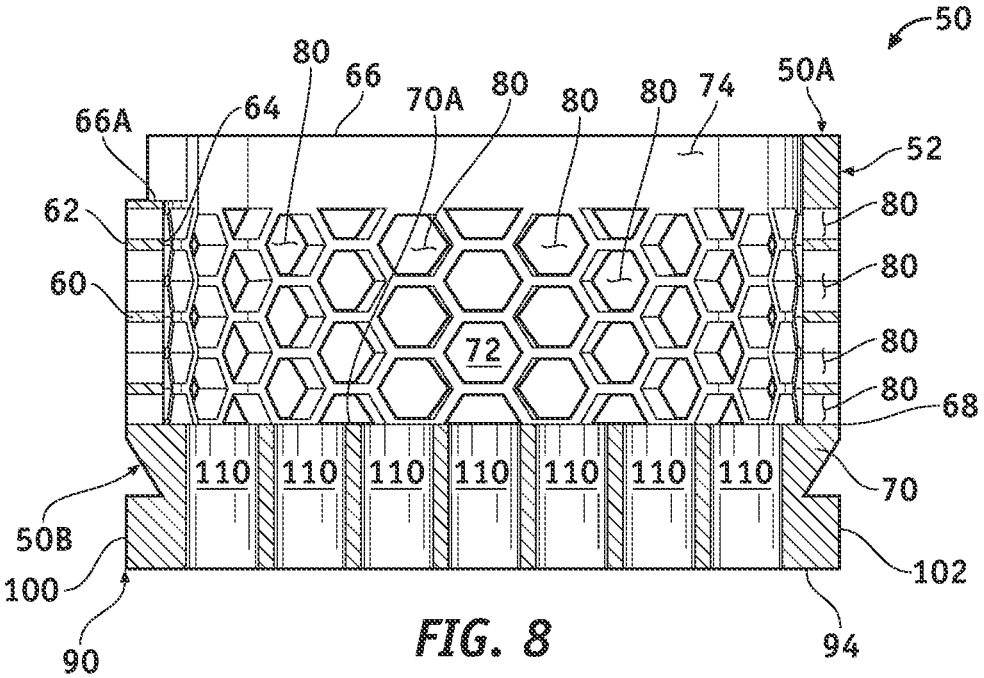
FIG. 8 is a section view taken along line 8-8 of FIG. 6.

A water transfer device, a cleaning implement including an assembly of the water transfer device and an applicator, and a water-dispensing pullout wand of a pulldown faucet configured with the cleaning implement are disclosed.

Referring in relevant part to FIGS. 1-8, illustrated is a water transfer device 50 configured to fluidly couple an applicator to a standard kitchen pulldown faucet's standard water-dispensing pullout wand. The applicator is a standard and readily-available replacement head, known in the art as a "dishwand" head, configured to connect to a dispensing end of a standard self-contained handle configured to hold and dispense a liquid cleanser, normally a liquid soap, to the applicator. Device 50 is easy to use, portable, being easily moved and carried about by hand, simple in structure, unpowered, inexpensive, and has no moving or electrical parts. Device 50 is made of plastic, an inexpensive and readily available material with inherently strong, rigid, resilient, and fluid- and chemical-resistant material characteristics.

Device 50 includes a proximal extremity 50A and a distal extremity 50B. Proximal extremity 50A is configured to be fluidly coupled to the pullout wand. Distal extremity 50B is configured to be coupled to the applicator. Device 50 is configured to fluidly couple proximal extremity 50A to the applicator when the applicator is coupled to distal extremity 50B.

Device 50 consists of a hollow body 52, including a continuous, annular sidewall 60 and a bottom wall 70. Sidewall 60 has outer surface 62, inner surface 64, annular upper edge or rim 66, and annular lower edge 68 affixed to bottom wall 70. Sidewall 60 extends between lower edge 68 affixed to bottom wall 70 at device's 50 distal extremity 50B and rim 66 at the opposed open top of hollow body 52 at device's 50 proximal extremity 50A. Bottom wall 70 has an inner or upper surface 70A and an outer or lower surface 70B. Upper surface 70A of bottom wall 70 cooperates with inner surface 64 to form a water-receiving volume 72. Rim 66 defines opening 74 to volume 72 configured to receive water discharged therein through opening 74 directly over upper surface 70A of bottom wall 70 from a pullout of a pullout faucet. Volume 72 is between opening 74 and upper surface 70A of bottom wall 70. Sidewall 60 is cylindrical, and rim 66 and opening 74 it defines are circular. Opening 74 is configured to accept the dispensing end of a pullout wand. At the same time, rim 66 is configured to be received over and frictionally secure the pullout wand.

Sidewall 60 has openings 80 extending through it from outer surface 62 to inner surface 64. Openings 80 formed in the material of sidewall 60 are between bottom wall 70 at distal extremity 50B and rim 66 at proximal extremity 50A, the open top of hollow body 52. Openings 80 are throughout sidewall's 60 circumference between bottom wall 70 at distal extremity 50B and rim 66 at proximal extremity 50A and are preferably distributed uniformly along sidewall's 60 circumference. Accordingly, sidewall 60 is an annular or circumferential openwork or "net-like" structure of openings 80 between proximal extremity 50A and distal extremity 50B. The array of openings 80, water-dispensing openings, circumferentially dispersed throughout sidewall's 60 circumference that form the circumferential openwork or net-like structure of device 50 between its proximal and distal extremities 50A and 50B allow water discharged into volume 72 through opening 74 by a standard pulldown faucet's standard water-dispensing pullout wand to flow circumferentially outward from volume 72 through openings 80. The flow water through openings 80 from device's 50 volume 72 is gentle and not forceful or harsh or extreme.

Distal extremity 50B has an elongate tongue 90 and openings 110. Tongue 90 is configured to be coupled standardly to a standard receiver of the known and readily-available dishwand replacement head. Tongue 90 is affixed to bottom wall's 70 lower surface 70B and depends downwardly to tongue's 90 lower surface 94. Tongue 90 is parallel to lower surface 70B and has opposed parallel sides 96 and 98 extending longitudinally between opposed parallel ends 100 and 102. Openings 110 extend vertically through bottom wall 70 from upper surface 70A to lower surface 70B and through tongue 90 to its lower surface 94. Openings 110 are parallel to one another, are between tongue's 90 sides 96 and 98 and between tongue's 90 ends 100 and 102, are open outwardly to volume 72 and opening 74 from upper surface 70A, and are open outwardly from tongue's 90 lower surface 94 and to the applicator when the applicator is coupled to tongue 90. Openings 110 fluidly couple volume 72 and opening 74 to the applicator when the applicator is coupled to tongue 90. Further, openings 110 fluidly couple the pulldown wand to the applicator when the applicator is coupled to tongue 90 and the pulldown wand is coupled to device's 50 open top as described herein.

Figure 9:
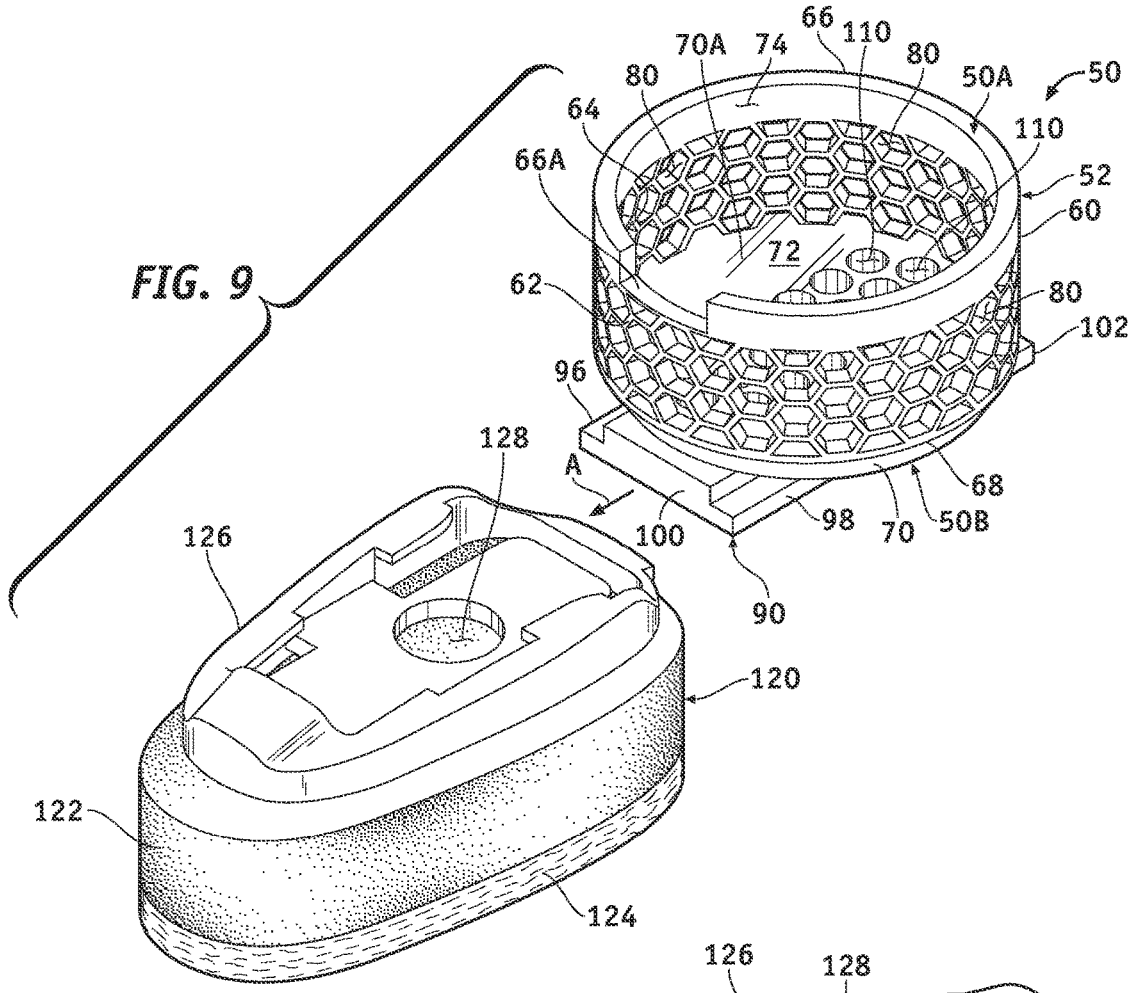
FIG. 9 is a front perspective view of a cleaning implement disassembled, the cleaning implement including the embodiment of FIG. 1 and an applicator in accordance with the principle of the invention.
Figure 10:
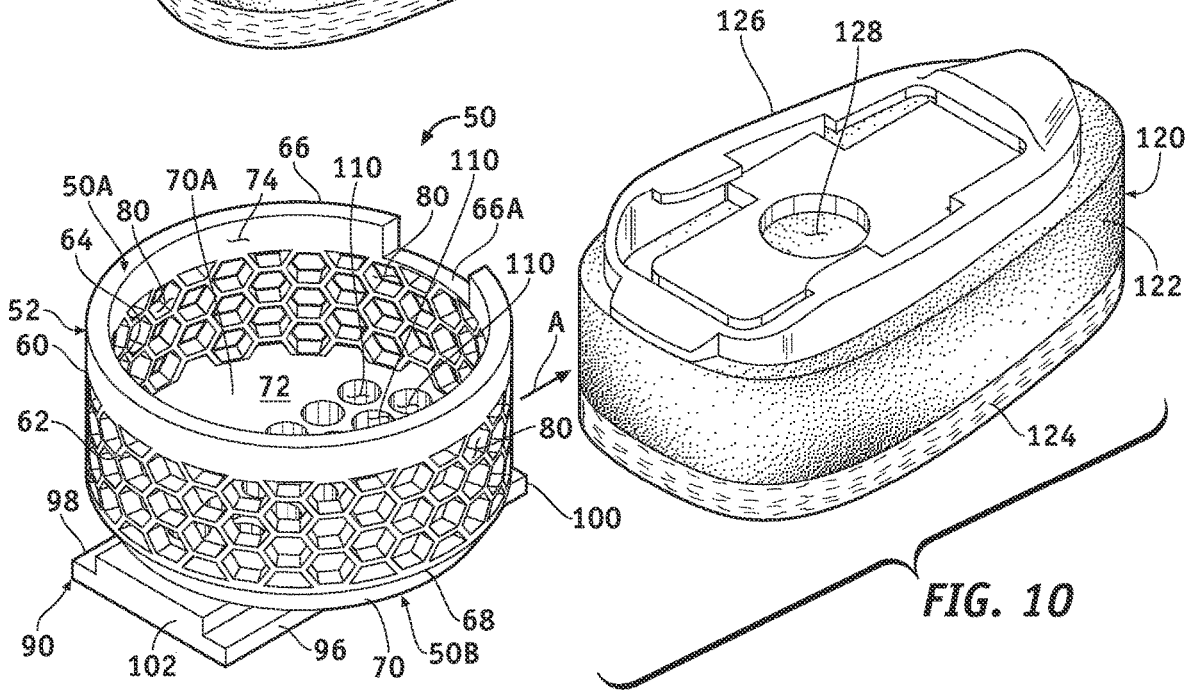
FIG. 10 is a rear perspective view of the embodiment of FIG. 9.
Figure 11:
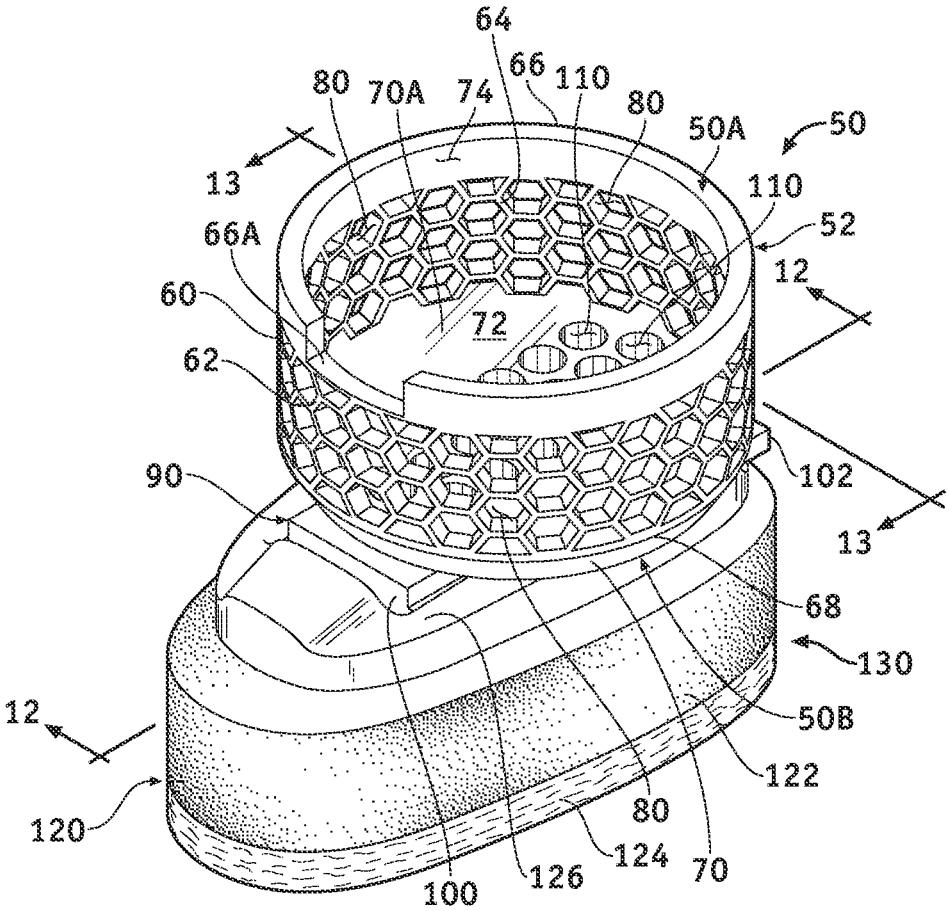
FIG. 11 is a perspective corresponding to FIG. illustrating the cleaning implement assembled.
Figure 12:
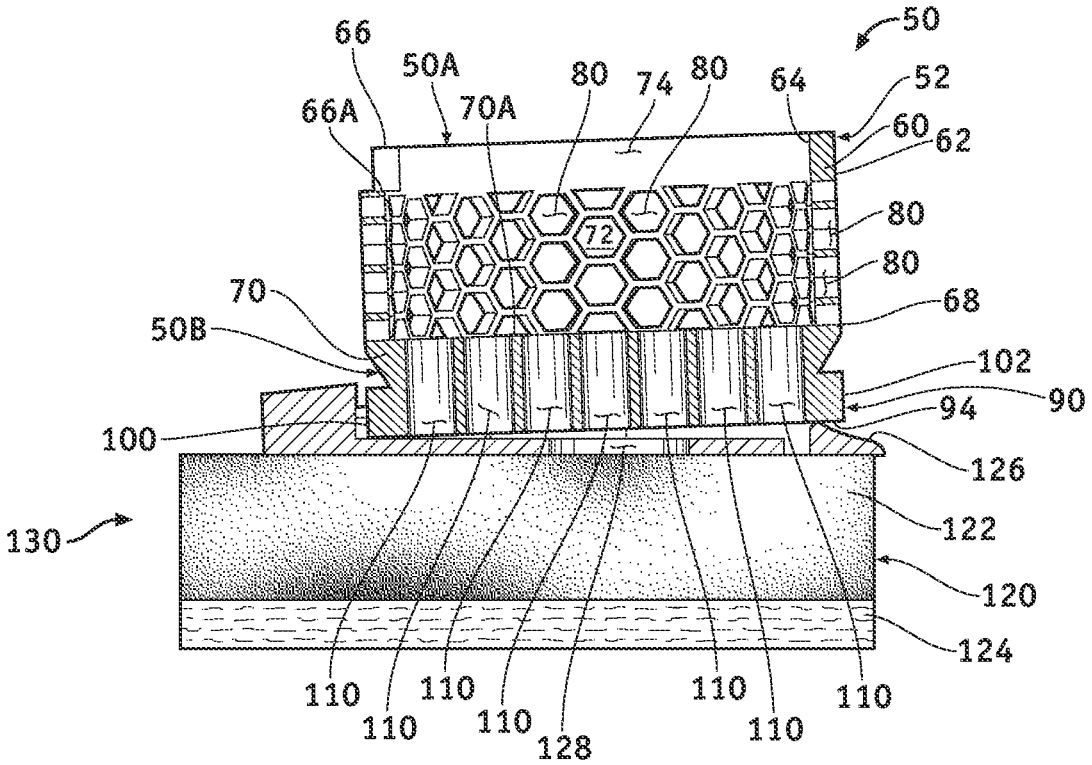
FIG. 12 is a section view taken alone line 12-12 of FIG. 11.
Figure 13:
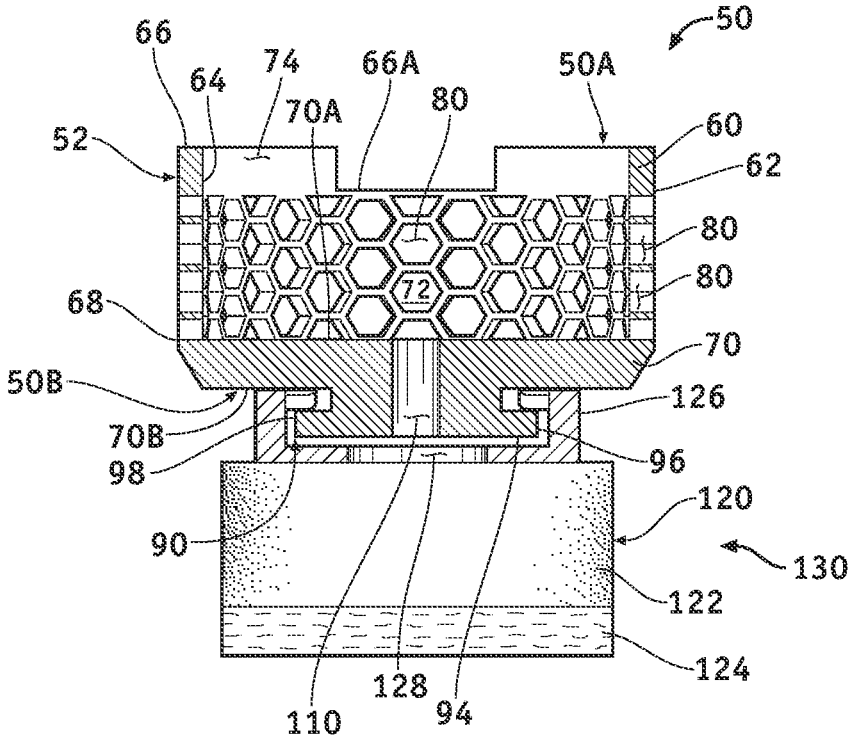
FIG. 13 is a section view taken along line 13-13 of FIG. 11.
Figure 14:
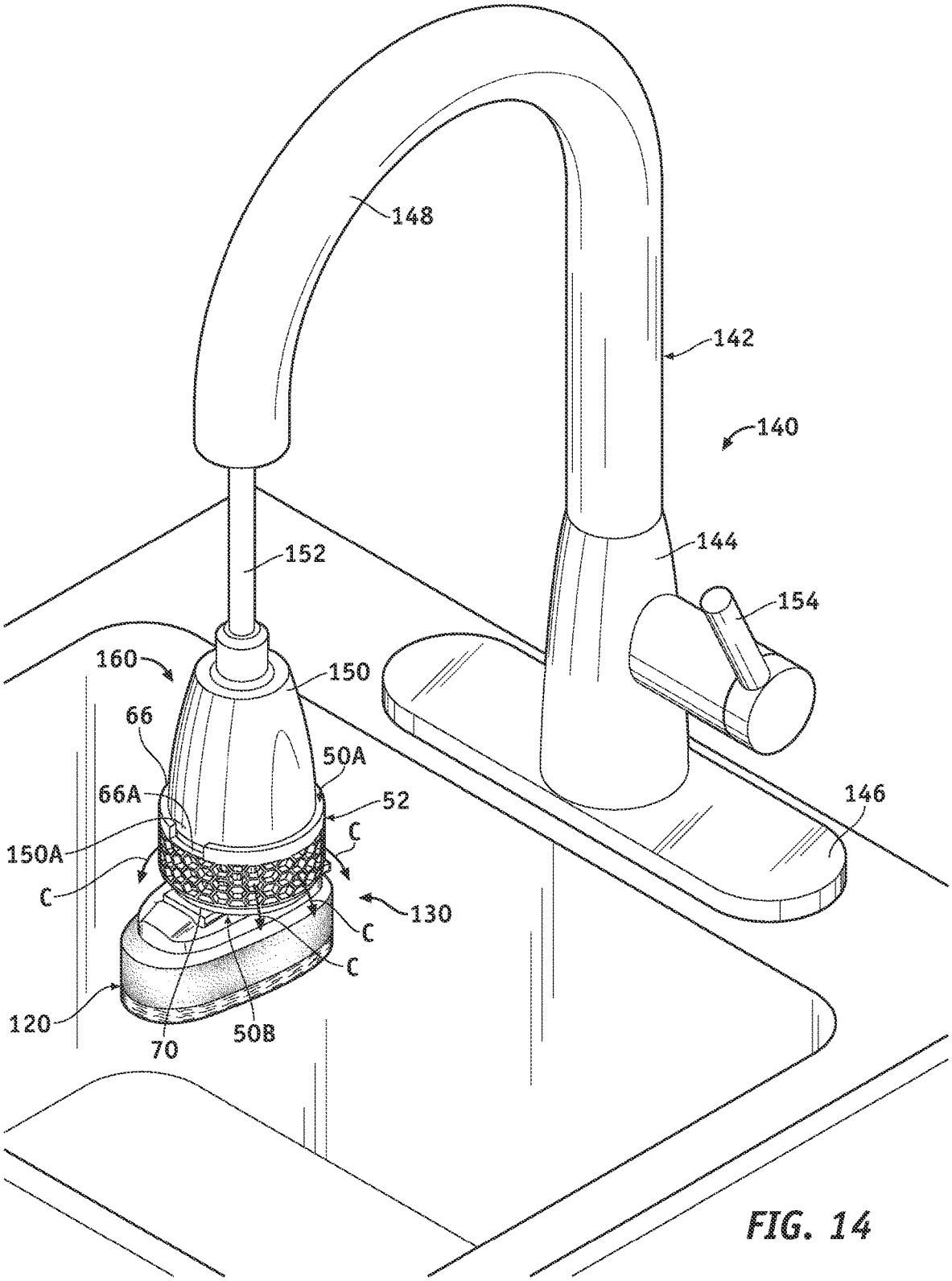
FIG. 14 is a perspective view of the embodiment of FIG. 11 coupled to a water-dispensing pullout wand of a pulldown faucet.
Figure 15:
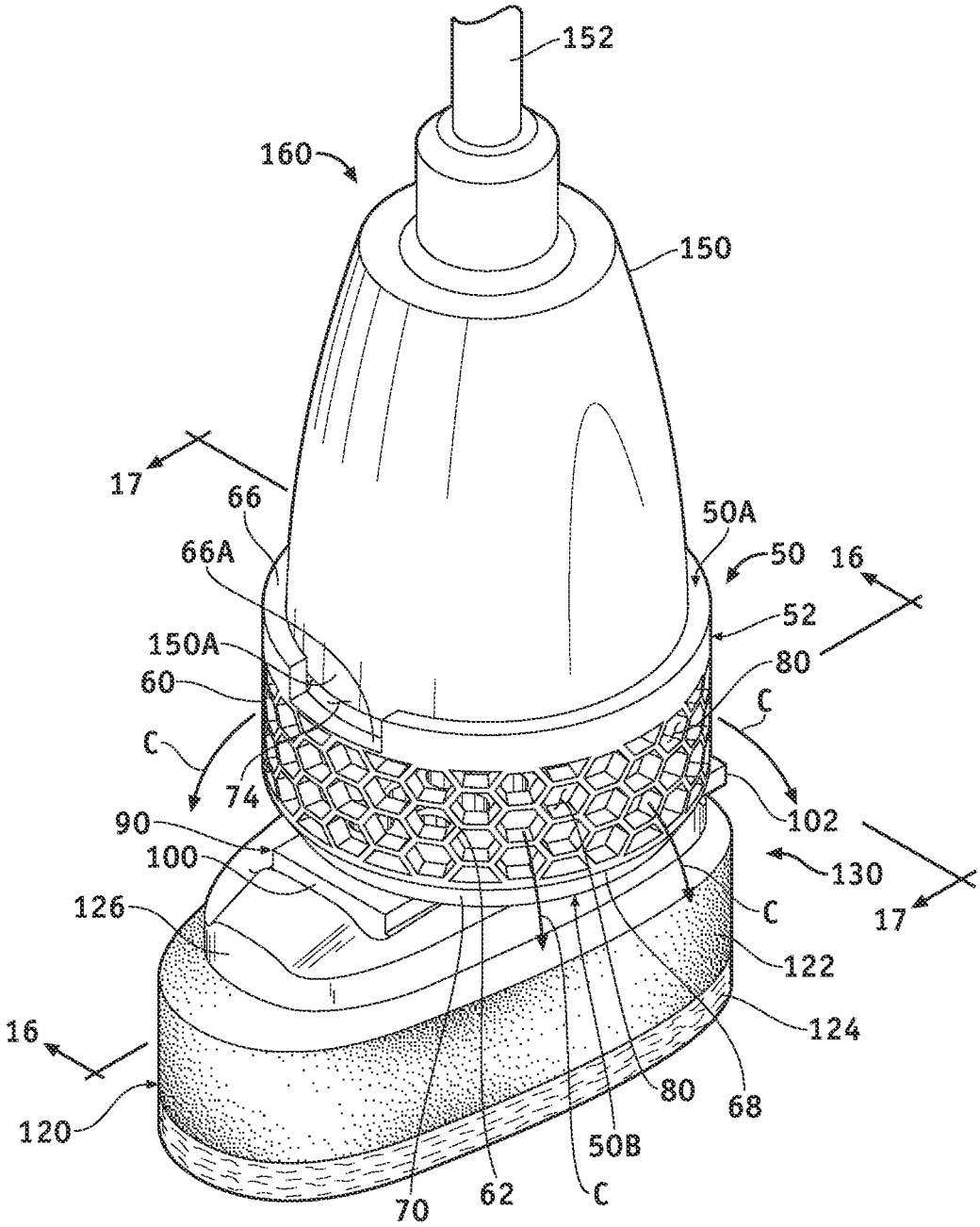
FIG. 15 is an enlarged, fragmentary view corresponding to FIG. 14 illustrating the cleaning implement coupled to the pullout wand.

The assembly of device 50 and the applicator 120 form a cleaning implement 130 in FIGS. 11-13 configured to be fluidly coupled to a standard pulldown faucet's 140 standard water-dispensing pullout wand 150 in FIG. 14. Again, applicator 120 is the standard and well-known replacement or dishwand head configured to connect to the dispensing end of a standard self-contained liquid cleaner dispensing handle and in the same way to tongue 90 in the present embodiment. As is known in the art, applicator 120 includes a sponge 122 that extends between an integrated scrubber pad 124 and an attached receiver 126 of plastic configured to be releasably coupled to tongue 90 and that has the customary central opening 128 open to sponge 122 to enable fluid transfer therethrough to sponge 122. Receiver 126 of standard construction is configured slidably receive and captively retain tongue 90 to connect applicator 120 to device 50. A user assembles device 50 and applicator 120 to form cleaning implement 130 in FIGS. 11-13 by simply sliding tongue 90 end 100 first in the direction of arrow A in FIGS. 9 and 10 into receiver 126 through its entrance gateway, captively retaining tongue 90 to receiver 126. The assembly of tongue 90 and receiver 126 couple device 50 to applicator 120. A user may withdraw applicator 120 from device 50 for replacement or cleaning purposes by simply reversing this operation. A user may assemble device 50 and applicator 120 to form cleaning implement 130 in FIGS. 11-13 by sliding tongue 90 end 102 first in the direction of arrow A in FIGS. 9 and 10 into receiver 126 through its rearward entrance in an alternate embodiment. Device 50 and applicator 120 may be repeatedly assembled as disassembled, and applicator 120 may be replaced with a new one when it is no longer useful.

Cleaning implement 130 in FIGS. 11-13 is the assembly of device 50 and applicator 120. Referring in relevant part to FIGS. 11-13, sponge 122 extends upright from scrubber pad 124 to receiver 126 releasably coupled to tongue 90 of device's 50 distal extremity 50B. Tongue 90 extends upright from receiver 126 to bottom wall 70, and annular sidewall 60 extends upright from bottom wall 70 to rim 66 encircling opening 74 to device's 50 volume 72. Openings 110 extend vertically through bottom wall 70 from upper surface 70A to lower surface 70B and through tongue 90 to its lower surface 94. Openings 110 are open outwardly to volume 72 and opening 74 from upper surface 70A, and are open outwardly from tongue's 90 lower surface 94 to applicator 120 and receiver's 126 opening 128 to sponge 122 fluidly coupling applicator 120 coupled to device's 50 distal extremity 50B to device's 50 volume 72 and proximal extremity 50A, namely, opening 74 of device's 50 open top defined by rim 66.

In FIG. 14, pulldown faucet 140 includes spout 142 and pullout wand 150. Spout 142 has a hub or base 144 mounted rotatably over a pedestal 146 mounted to the sink's deck. Base 146 has an outlet or receiver 148, removably receiving pullout wand 150. Base 144 and its receiver 148 slidably receive a flexible conduit 152 fluidly coupling pullout wand 150 to the faucet's 140 hot/cold water supply, enabling movement of pullout wand 150 between a docked position docked to receiver 148 and an undocked position extended from receiver 148 as shown in FIG. 14. Pullout wand 150 is easily moved and pointed in different directions for projecting the flow of water from water-dispensing end 150A where desired when pullout wand 150 is undocked and extended from receiver 148. Base's 144 standard manual valve handle 154 is used to establish water flow pullout wand 150. Faucet 140 and its various appurtenances are well-known, further details of which will readily occur to the person having ordinary skill in the art.

A user couples cleaning implement 130 to pullout wand 150 simply by pressing pullout wand's 150 dispensing end 150A into volume 72 through opening 74 frictionally securing inner surface 64 of rim 66 over and against dispensing end 150A. The circumferences of dispensing end 150A and rim's 66 inner surface 64 correspond to allow rim's 66 inner surface 64 to directly frictionally and tightly contact and secure dispensing end 150A releasably to proximal extremity 50A when rim's 66 inner surface 64 is received forcibly over dispensing end 150A. The fit of inner surface 64 of rim 66 over pullout wand's 150 dispensing end 150A is a press, friction, or interference fit, a form of fastening between two tightly fitting mating parts that produces a joint which is held together by friction after the parts are pushed together by hand. A user may detach cleaning implement 130 from pullout wand 150 by simply reversing this operation, by pulling apart pullout wand 150 and cleaning implement 130 by hand. Cleaning implement 130 and pullout wand 150 may be repeated assembled and disassembled by hand without modifying pullout wand 150 or cleaning implement 130 and without damaging pullout wand 150.

In FIGS. 1, 2, 4, 5-16, 18, and 20, rim 66 is notched by notch 66A. This notch 66A severs rim 66 enabling it to slightly expand and contract to fit over and tighten against pullout wand's 150 dispensing end 150A.

The assembly 160 of cleaning implement 130 and pullout wand 150 will now be discussed briefly with reference in relevant part to FIGS. 14-19. Sponge 122 extends upright from scrubber pad 124 to receiver 126 coupled to tongue 90 of device's 50 distal extremity 50B. Tongue 90 extends upright from receiver 126 to bottom wall 70, and annular sidewall 60 extends upright from bottom wall 70 to rim 66 encircling opening 74 to device's 50 volume 72 and to dispensing end 150A extending into volume 72 from opening 74 defined by rim 66 received over pullout wand's 150 dispensing end 150A. Inner surface 64 of rim 66 extends over, encircles, and frictionally secures pullout wand's 150 dispensing end 150A. Openings 110 extend vertically through bottom wall 70 from upper surface 70A to lower surface 70B and through tongue 90 to its lower surface 94. Openings 110 are open outwardly to volume 72 and opening 74 and discharge end 150A from upper surface 70A, and are open outwardly from tongue's 90 lower surface 94 to applicator 120 and receiver's 126 opening 128 to sponge 122 fluidly coupling applicator 120 coupled to device's 50 distal extremity 50B to device's 50 volume 72, opening 74, and pullout wand's 150 discharge end 150A releasably secured by device's 50 open top.

Figure 16:
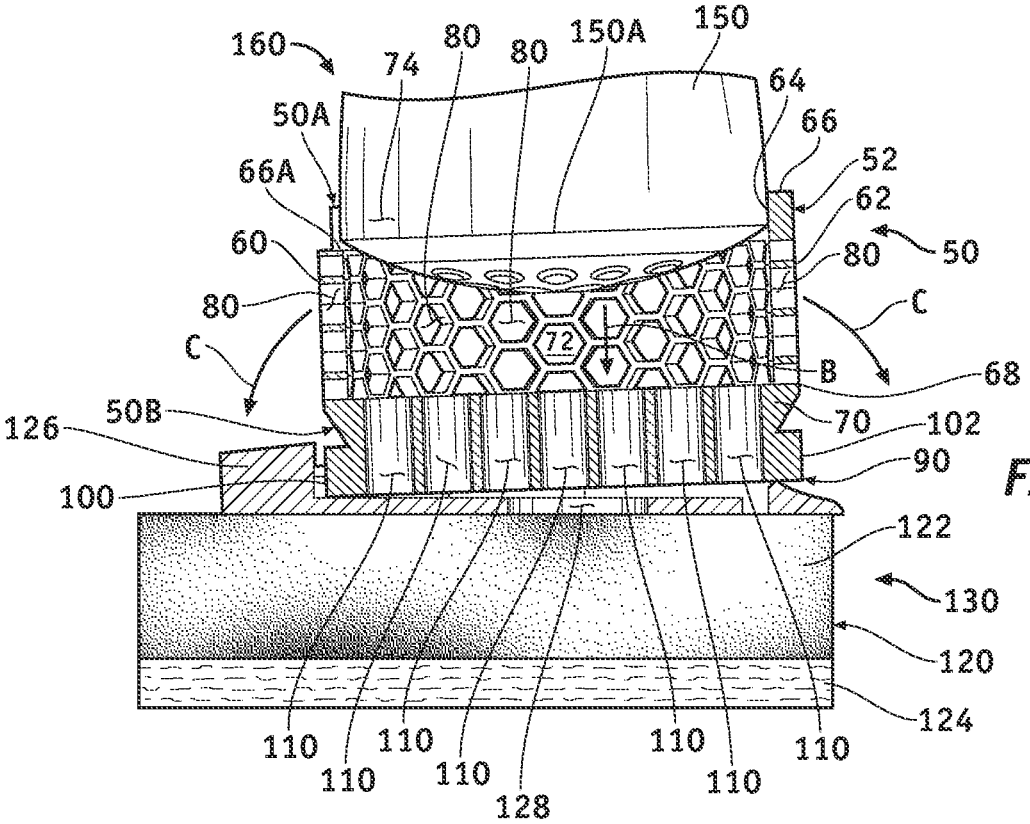
FIG. 16 is a section view taken along line 16-16 of FIG. 15.
Figure 17:
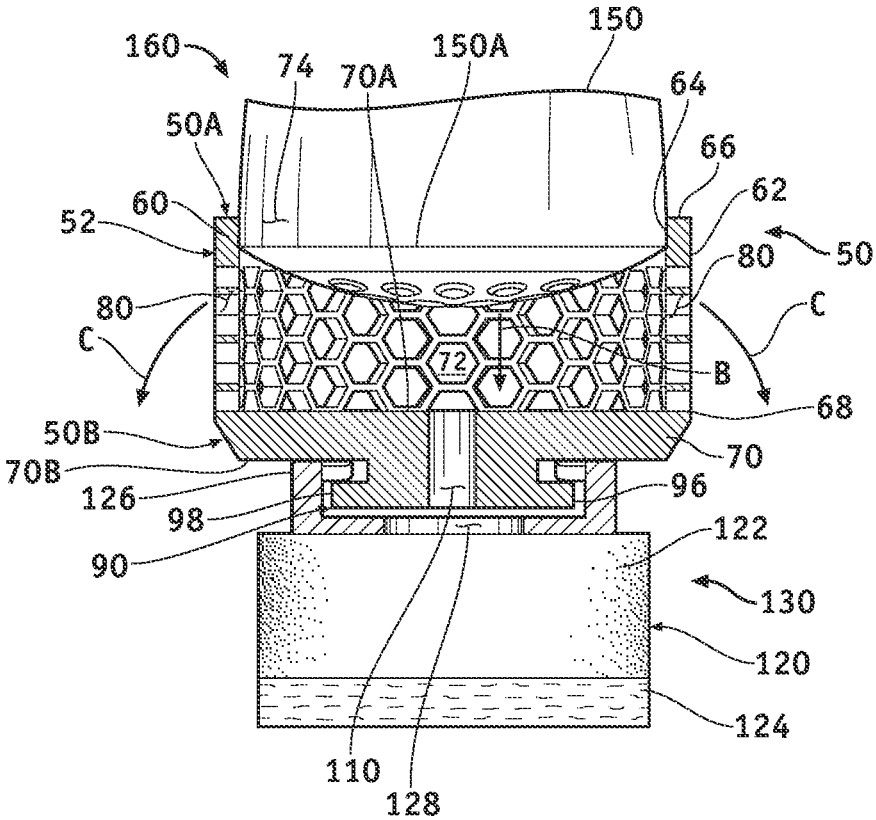
FIG. 17 is a section view taken along line 17-17 of FIG. 15.
Figure 18:
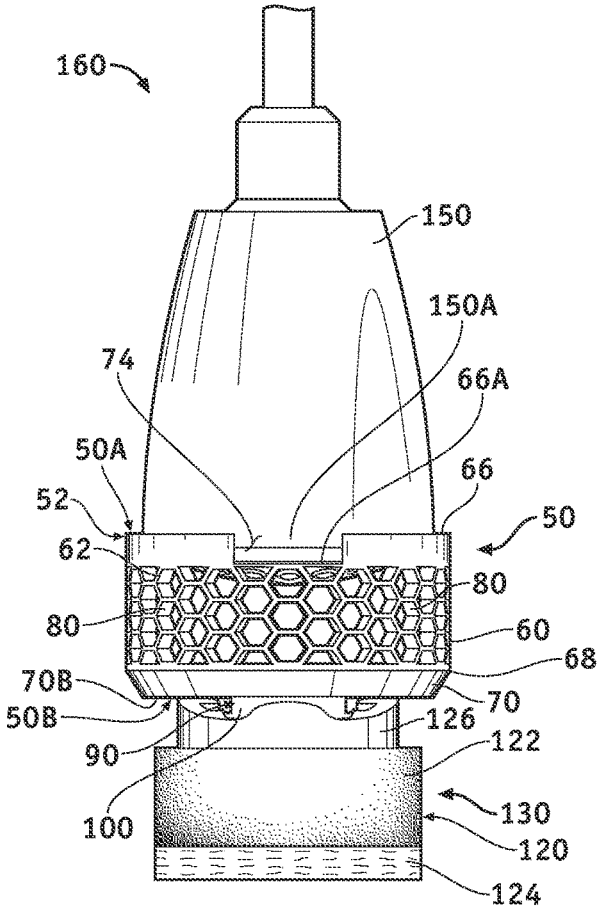
FIG. 18 is a front perspective view of the embodiment of FIG. 15.
Figure 19:
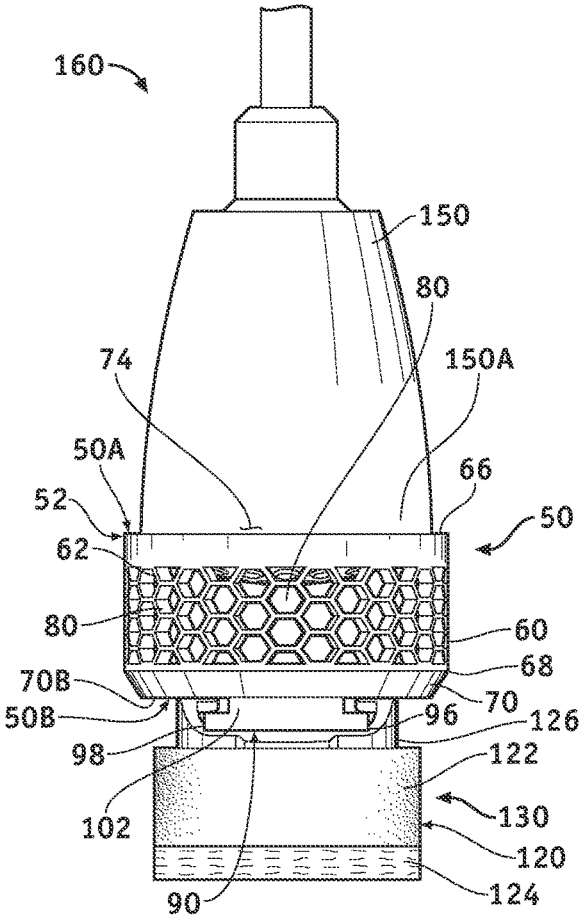
FIG. 19 is a rear perspective view of the embodiment of FIG. 15.
Figure 20:
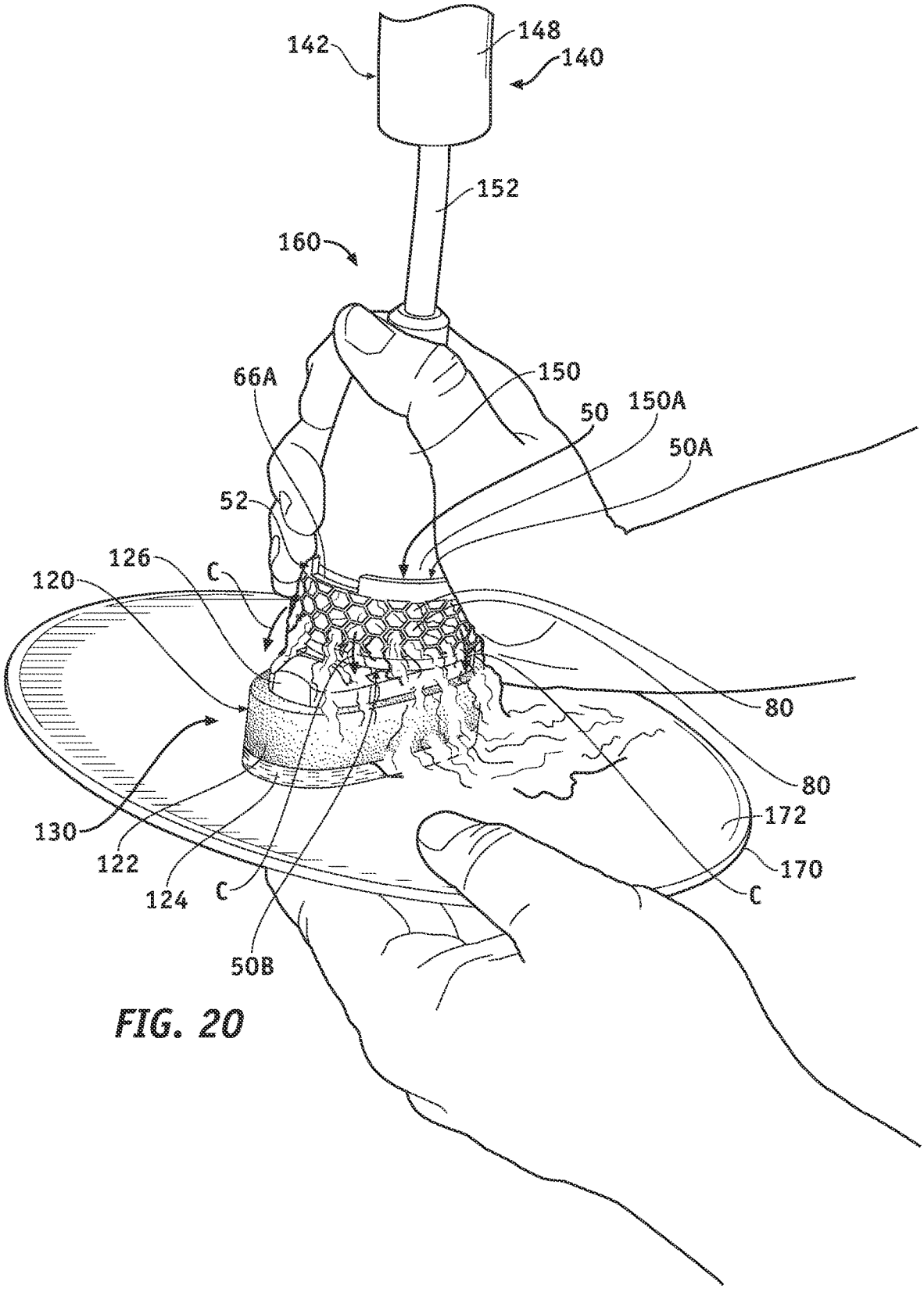
FIG. 20 is a view corresponding to FIG. 14 illustrating the assembly of the cleaning implement and the pullout wand in use.

The assembly 160 of cleaning implement 130 and pullout wand 150 is useful for cleaning dishware, cookware, cutlery, and drinkware at a kitchen sink. The user takes up pullout wand 150 with one hand, undocks it from receiver 148, and turns on faucet 140 (FIG. 14) with valve handle 154 to establish water flow to volume 72 through opening 74 from pullout wand 150. Referring to FIGS. 16 and 17, pullout wand's 150 discharge end 150A discharges water downwardly into volume 72 through opening 74 in the direction of arrow B. The water floods volume 72 and flows downwardly in the direction of arrow B to applicator 120 from volume 72 through openings 110 and to sponge 122 through receiver's opening 128. The water permeates and flows through sponge 122 to its integrated scrubber pad 124 moistening them. At the same time, the water flows circumferentially outwardly from volume 72 through sidewall's 60 openings 80, gently and not forcefully or harshly, flowing downwardly over and around applicator 120 in the directions generally indicated by arrows C in FIGS. 15-20. In FIG. 20, the user holds pullout wand 150 by hand like a handle, applies scrubber pad 124 against a surface to be cleaned, the surface 172 of a lid 170 in this example held by the user's other hand, and moves assembly 160 back and forth by hand scrubbing surface 172 with the scrubber pad 124. The flow of water from discharge end 150A of pullout wand 150 into device's 50 volume 72 flows from volume 72 to applicator 120 through openings 110 keeping applicator 120 moist and, at the same time, circumferentially outwardly through sidewall's 60 openings 80 across sidewall's circumference and downwardly over applicator 120 and onto surface 172. While he scrubs surface 172 with scrubber pad 124 while holding pullout wand 150 as a handle, the water flowing through openings 110 from volume 72 to the applicator 120 moistening it and the water flowing circumferentially outwardly through openings 80 from volume 72 and over the applicator 120 dissolves and washes away impurities in conjunction with the scrubbing action applied by scrubber pad 124. A user can use a liquid soap or cleanser during this process simply by dispensing it onto applicator 120 or surface 172. The configuration of assembly 160 exploits pullout wand 150 as a water-dispensing handle fluidly coupled to applicator 120 supplying water to and over applicator 120 while the user holds pullout wand 150 and uses it to scrub surfaces with applicator 120. After cleaning is complete, a user may turn off faucet 140 with valve handle 154 in FIG. 14, dock pullout wand 150 to receiver 148, withdraw cleaning implement 130 from pullout wand 150, and separate applicator 120 form device 150, rinse them, and leave them out to dry.

Figure 21:
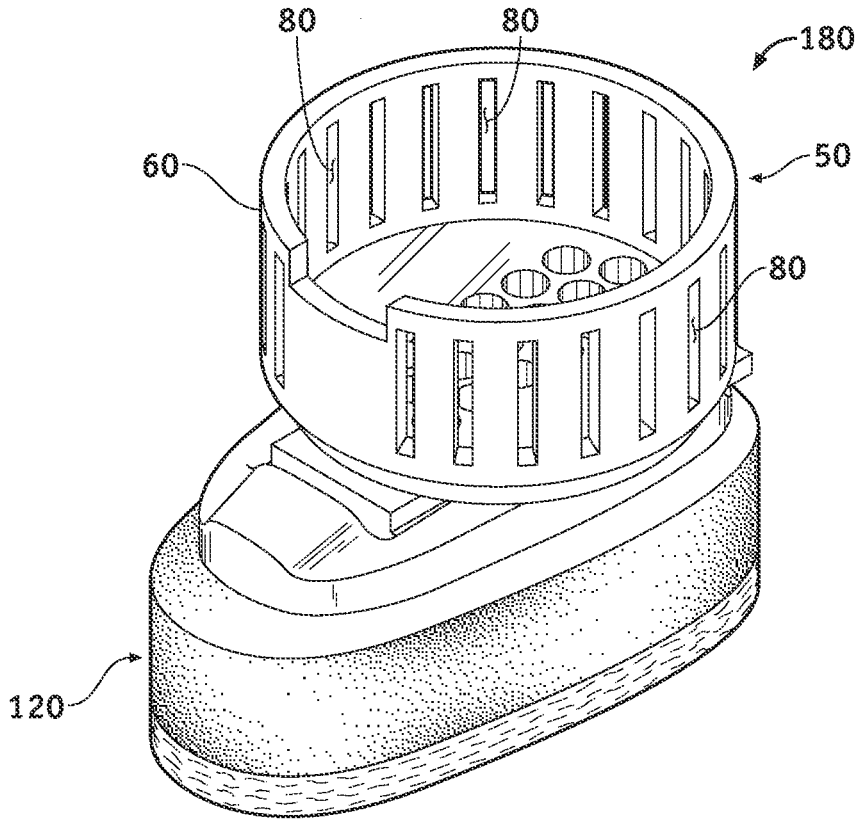
FIG. 21 is a perspective view of an alternate embodiment of a cleaning implement constructed and arranged in accordance with the invention.

Federal regulations in the United States specify that the flow rate of a kitchen faucet should not exceed 2.2 gallons per minute (GPM). At or below this standard flow rate, the water discharged into and flooding volume 72 through device's 50 open top from discharge end 150A of pullout wand 150 flows outwardly from volume 72 through openings 80 throughout sidewall's 60 circumference gently and not forcefully or harshly, flowing downwardly over and around applicator 120 as described above. This water flow characteristic results from the described configuration of population of openings 80 and how they form the described circumferential openwork or net-like structure of sidewall 60 between device's 50 proximal and distal extremities 50A and 50B. In this example, the various sidewall 60 openings 80 are hexagonal in shape, some being halved where the openings 80 meet rim 66 and bottom wall 70. Openings 80 can be circular, oval, rectangular, square, etc., in alternate embodiments. As a matter of example, FIG. 21 illustrates an alternate embodiment of a cleaning implement 180 consisting of the assembly of the previously-described device 50 and applicator 120. Sidewall 60 openings 80 of cleaning implement 180 are elongate and vertically upright, parallel to one another, and equally spaced apart circumferentially. Other sidewall 60 opening 80 configurations configured to form a circumferential openwork or net-like structure in sidewall 60 can be used in alternate embodiments consistent with this disclosure.

As disclosed herein, distal extremity's 50B elongate tongue 90 is configured to be coupled standardly to the standard receiver 126 of the known and readily-available dishwand replacement head 120. Tongue 90 carried by device 50 and receiver 126 carried by applicator 120 are mutually-engageable engagement elements configured to releasably engage one another for releasably engaging device 50 to applicator 120. While device 50 carries tongue 90 and applicator 120 carries receiver 126, this positioning can be reversed in alternate embodiments.

Different varieties of dispensing tools can have other forms of engagement assemblies configured to releasably secure the given applicator to the given dispensing end of the self-contained fluid-dispensing handle. A device and corresponding applicator constructed and arranged according to the invention can be configured with any desired form of mutually-engageable engagement elements suitable to releasably secure the device to the applicator consistent with the teachings of this specification.

The present invention is described above with reference to illustrative embodiments. Those skilled in the art will recognize that changes and modifications may be made in the described embodiments without departing from the nature and scope of the present invention. Various changes and modifications to the embodiments herein chosen for purposes of illustration will readily occur to those skilled in the art. To the extent that such modifications and variations do not depart from the invention, they are intended to be included within the scope thereof.

The invention claimed is:

1. In a water-dispensing pullout wand of a pulldown faucet and an applicator, wherein the improvement comprises: a hollow body fluidly coupling the pullout wand to the applicator, and openings through the hollow body between the pullout wand and the applicator, the openings enabling water applied to the hollow body from the pullout wand to flow outwardly therethrough and over the applicator from the hollow body between the pullout wand and the applicator.

2. The improvement according to claim 1, wherein the openings are throughout the hollow body between the pullout wand and the applicator.

3. The improvement according to claim 1, wherein the hollow body is received releasably over the pullout wand fluidly coupling the pullout wand to the applicator.

4. The improvement according to claim 1, further comprising an engagement assembly releasably coupling the hollow body to the applicator, the engagement assembly comprising an element thereof carried by the hollow body and a complemental element thereof carried by the applicator, the element in releasable engagement to the complemental element.

5. The improvement according to claim 4, wherein the element comprises one of a tongue and a receiver and the complemental element comprises another one of the tongue and the receiver, the releasable engagement comprising the tongue received releasably by the receiver.

6. A cleaning implement, comprising:

a hollow body including a proximal extremity configured to be fluidly coupled to a water-dispensing pullout wand of a pulldown faucet, and a distal extremity coupled to an applicator, and at least one opening through the distal extremity fluidly coupling the proximal extremity to the applicator; and openings through the hollow body between the proximal extremity and the distal extremity, the openings enabling water applied to the hollow body through the proximal extremity from the pullout wand to flow outwardly therethrough and over the applicator from the hollow body between the proximal extremity and the distal extremity when the proximal extremity is fluidly coupled to the pullout wand.

7. The cleaning implement according to claim 6, wherein the openings are throughout the hollow body between the proximal extremity and the distal extremity.

8. The cleaning implement according to claim 6, wherein the proximal extremity is configured to be received releasably over the pullout wand for fluidly coupling the proximal extremity to the pullout wand.

9. The cleaning implement according to claim 6, further comprising an engagement assembly releasably coupling the hollow body to the applicator, the engagement assembly comprising an element thereof carried by the hollow body and a complemental element thereof carried by the applicator, the element in releasable engagement to the complemental element.

10. The cleaning implement according to claim 9, wherein the element comprises one of a tongue and a receiver and the complemental element comprises another one of the tongue and the receiver, the releasable engagement comprising the tongue received releasably by the receiver.

11. A water transfer device, comprising:

a hollow body including a proximal extremity configured to be fluidly coupled to a water-dispensing pullout wand of a pulldown faucet, a distal extremity configured to be coupled to an applicator, and at least one opening through the distal extremity, the at least one opening fluidly coupling the proximal extremity to the applicator when the distal extremity is coupled to the applicator; and openings through the hollow body between the proximal extremity and the distal extremity, the openings enabling water applied to the hollow body through the proximal extremity from the pullout wand to flow outwardly therethrough and over the applicator from the hollow body between the proximal extremity and the distal extremity when the proximal extremity is fluidly coupled to the pullout wand and the distal extremity is coupled to the applicator.

12. The water transfer device according to claim 11, wherein the openings are throughout the hollow body between the proximal extremity and the distal extremity.

13. The water transfer device according to claim 11, wherein the proximal extremity is configured to be received releasably over the pullout wand for fluidly coupling the proximal extremity to the pullout wand.

14. The water transfer device according to claim 11, further comprising an engagement assembly configured to couple the distal extremity to the applicator, the engagement assembly comprising an element thereof carried by the distal extremity and a complemental element thereof carried by the applicator, the element configured to releasably engage the complemental element.

15. The water transfer device according to claim 14, the element comprising one of a tongue and a receiver and the complemental element comprising another one of the tongue and the receiver, the tongue configured to releasably engage the receiver by being received releasably by the receiver.

16. In a water-dispensing pullout wand of a pulldown faucet and an applicator, wherein the improvement comprises:

a hollow body comprising an annular wall extending between an open top fluidly coupled to the pullout wand and a bottom wall coupled to the applicator;

at least one opening through the bottom wall fluidly coupling the proximal extremity to the applicator; and openings through the annular wall between the open top and the bottom wall, the openings enabling water applied to the hollow body through the open top from the pullout wand to flow outwardly therethrough and over the applicator from the annular wall between the open top and the bottom wall.

17. The improvement according to claim 16, wherein the openings are throughout the annular wall.

18. The improvement according to claim 16, wherein the open top is received releasably over the pullout wand fluidly coupling the open top to the pullout wand.

19. The improvement according to claim 16, further comprising an engagement assembly releasably coupling the bottom wall to the applicator, the engagement assembly comprising an element thereof carried by the bottom wall and a complemental element thereof carried by the applicator, the element in releasable engagement to the complemental element.

20. The improvement according to claim 19, wherein the element comprises one of a tongue and a receiver and the complemental element comprises another one of the tongue and the receiver, the releasable engagement comprising the tongue received releasably by the receiver.

21. A cleaning implement, comprising:

a hollow body comprising an annular wall extending between an open top configured to be fluidly coupled to a water-dispensing pullout wand of a pulldown faucet and a bottom wall coupled to an applicator;

at least one opening through the bottom wall fluidly coupling the proximal extremity to the applicator; and openings through the annular wall between the open top and the bottom wall, the openings enabling water applied to the hollow body through the open top from the pullout wand to flow outwardly therethrough and over the applicator from the annular wall between the open top and the bottom wall when the open top is fluidly coupled to the pullout wand.

22. The cleaning implement according to claim 21, wherein the openings are throughout the annular wall.

23. The cleaning implement according to claim 21, wherein the open top is configured to be received releasably over the pullout wand for fluidly coupling the open top to the pullout wand.

24. The cleaning implement according to claim 21, further comprising an engagement assembly releasably coupling the bottom wall to the applicator, the engagement assembly comprising an element thereof carried by the bottom wall and a complemental element thereof carried by the applicator, the element in releasable engagement to the complemental element.

25. The cleaning implement according to claim 24, wherein the element comprises one of a tongue and a receiver and the complemental element comprises another one of the tongue and the receiver, the releasable engagement comprising the tongue received releasably by the receiver.

26. A water transfer device, comprising:

a hollow body comprising an annular wall extending between an open top configured to be fluidly coupled to a water-dispensing pullout wand of a pulldown faucet and a bottom wall configured to be coupled to an applicator;

at least one opening through the bottom wall, the at least one opening fluidly coupling the open top to the applicator when the bottom wall is coupled to the applicator; and openings through the annular wall between the open top and the bottom wall, the openings enabling water applied to the hollow body through the open top from the pullout wand to flow outwardly therethrough and over the applicator from the annular wall between the open top and the bottom wall when the open top is fluidly coupled to the pullout wand and the bottom wall is coupled to the applicator.

27. The water transfer device according to claim 26, wherein the openings are throughout the annular wall.

28. The water transfer device according to claim 26, wherein the open top is configured to be received releasably over the pullout wand for fluidly coupling the open top to the pullout wand.

29. The water transfer device according to claim 26, further comprising an engagement assembly configured to couple the bottom wall to the applicator, the engagement assembly comprising an element thereof carried by the bottom wall and a complemental element thereof carried by the applicator, the element configured to releasably engage the complemental element.

30. The water transfer device according to claim 29, the element comprising one of a tongue and a receiver and the complemental element comprising another one of the tongue and the receiver, the tongue configured to releasably engage the receiver by being received releasably by the receiver.

* * * * *